United States Patent [19]

Birch et al.

[11] Patent Number: 4,842,544

[45] Date of Patent: Jun. 27, 1989

[54] METHOD AND APPARATUS FOR TERMINATING HIGH-SPEED SIGNAL TRANSMISSION CABLE

[75] Inventors: Norman R. Birch, Jacobus; William V. Pauza, Palmyra, both of Pa.

[73] Assignee: AMP Incorporated, Harrisburg, Pa.

[21] Appl. No.: 145,671

[22] Filed: Jan. 14, 1988

Related U.S. Application Data

[63] Continuation of Ser. No. 897,577, Aug. 18, 1986, abandoned.

[51] Int. Cl.[4] ..... H01R 4/24

[52] U.S. Cl. ..... 439/387; 439/443; 439/374; 439/578

[58] Field of Search ..... 439/389–414, 439/417, 418, 427, 443, 387, 374, 578

[56] References Cited

U.S. PATENT DOCUMENTS

| | | | |
|---|---|---|---|
| 2,593,743 | 4/1952 | Galvao | 173/361 |
| 3,012,219 | 12/1961 | Levin et al. | 339/98 |
| 3,142,524 | 7/1964 | McDonough | 339/98 |
| 3,274,530 | 11/1963 | Michaely | 339/97 |
| 3,377,610 | 4/1968 | Busch et al. | 339/95 D |
| 3,864,010 | 2/1975 | Wasserlein, Jr. | 339/97 R |
| 3,963,319 | 6/1976 | Schumacher et al. | 339/17 F |
| 3,990,766 | 11/1976 | Volinskie et al. | 339/177 E |
| 4,066,316 | 1/1978 | Rollings | 339/97 R |
| 4,163,598 | 8/1979 | Bianchi et al. | 339/107 |
| 4,225,207 | 9/1980 | Brandeau et al. | 339/95 R |
| 4,365,856 | 12/1982 | Yaegashi et al. | 339/17 F |
| 4,403,820 | 9/1983 | Rich | 339/97 R |
| 4,649,636 | 3/1987 | Arbogast, Jr. et al. | 29/861 |
| 4,681,382 | 7/1987 | Lockard | 439/92 |

*Primary Examiner*—David Pirlot

[57] ABSTRACT

A connector and method of termination for high speed signal cable of small physical dimension. The connector embodies a wire manager plastic fixture (22) into which the fine signal and ground wires (18,20) of a cable (10) are inserted and folded back in a precise location to form an ensemble. This ensemble has a geometry to allow ease of handling and orientation to be inserted into the rear portion of a connector (40) with the wires (18,20) sliding in engagement with slotted connector blade portions (42,46) to assure proper assembly. Blade portions (42,46) are radially forced inwardly to cause the wires (18,20) to be captured in slots therein (44,48) to be additionally terminated as by welding. A variety of types of connector front ends are disclosed.

13 Claims, 9 Drawing Sheets

METHOD AND APPARATUS FOR TERMINATING HIGH-SPEED SIGNAL TRANSMISSION CABLE

This application is a Continuation of application Ser. No. 897,577 filed Aug. 18,1986, now abandoned.

The present invention relates to method and apparatus for terminating high-speed signal transmission cable embracing a method for handling small parts of signal connectors relative to small parts of transmission cable. The invention relates to a method and an apparatus for accurate manipulation of slender conductive wires of an electrical cable used as a transmission line for high speed electrical signals, and for accurate manipulation of small metal parts to form electrical connections between the slender wires and the small metal parts for use in an electrical connector assembly that causes negligible backward cross talk and minimum reflection of signals propagating in the transmission line.

BACKGROUND OF THE INVENTION

Electrical signals useful for data transmission and data computation propagate at high speed along electrical transmission lines that are constructed for low electrical capacitance, for low electrical attenuation, for shielding against cross talk and for slender physical size to permit dense grouping together as in high density wiring in electronic equipment.

A typical electrical cable suitable for use as a transmission line for propogation of high speed electrical signals is comprised of a conductive slender wire serving as a signal carrying conductor surrounded concentrically by a solid dielectric material with a dielectric constant carefully selected for minimized impedance to the velocity of the signals, in turn surrounded by a conductive foil that is conductively joined with a slender conductive drain wire that extends the length of the foil and serves as a convenient electrical terminal to which an electrical connection can be made and established as an electrical connection with the foil.

The cable is carefully constructed with a geometry of small physical size and a constant electrical characteristic impedance. The small physical size of the cable must be appreciated. For example, a cable of 50 Ohms characteristic impedance has a signal carrying conductor size of 30 AWG, surrounded concentrically by a dielectric of 0.68 millimeter diameter, a drain wire size of 30 AWG sheathed in a dielectric jacket that provides the outer diameter of the cable of 1.78 millimeter maximum. The centerlines of the conductor and drain wire are spaced apart 0.49 millimeter.

A cable of 0.75 Ohms characteristic impedance has a signal carrying conductor size of 32 AWG, surrounded concentrically by a dielectric of 0.75 millimeter diameter, a drain wire size of 32 AWG sheathed in a dielectric jacket that provides the outer diameter of the cable of 1.78 millimeter maximum. The centerlines of the conductor and drain wire are spaced apart 0.50 millimeter.

A cable of 90 Ohms characteristic impedance has a signal carrying conductor size of 32 AWG, surrounded concentrically by a dielectric of 1.0 millimeter diameter, a drain wire size of 32 AWG sheathed in a dielectric jacket that provides the outer diameter of the cable of 1.78 millimeter maximum. The centerlines of the conductor and drain wire are spaced apart 0.73 millimeter.

The physical presence of an electrical connector assembly along an electrical cable for transmission of high speed electrical signals is a disruption of the carefully selected geometry of the cable. The connector assembly is a potential source of distortion of the signals. For example, the connector assembly is a potential source of signal cross talk in a backward or reverse direction of signal propogation. The connector assembly is a potential source of spurious signals caused by reflection of the propagating signals, especially propagating signals having voltage wave forms with short rise times.

An electrical connector assembly suitable for combination with a cable for transmission of high speed signals must be of small physical size to permit passage of propagating signals along the connector assembly with negligible cross talk and with minimum signal reflection. It is foreseen that a connector assembly of small size is difficult to manipulate during assembly with slender wires of a cable having the above-identified small dimensions. Despite its small size, the connector assembly must possess a geometry that is constructed for tactile identification and manual or machine manipulation, especially during assembly with a cable having slender wires.

Further, it is foreseen that a connector assembly of small size must separate the slender wires of the cable from one another to prevent an electrical short circuit. The connector assembly must establish electrical connections of the wires with corresponding electrical terminals of small metal parts in the connector assembly.

Accordingly, the connector assembly must be constructed for accurate manipulation of conductive slender wires of an electrical cable used as a transmission line for high speed electrical signals, and for accurate manipulation of small metal parts to form electrical connections between the slender wires and the small metal parts for use in an electrical connector assembly that causes negligible backward cross talk and minimum reflection of signals propagating in the transmission lines.

Inexorably, speeds of intelligence manipulation and transmission appear to go up. As this occurs, speeds of signal transmission follow suit. From the days of Morse Code, when bit rates could be measured in 50 characters per minute, the time has come when binary signals are regularly transmitted within a computer at rates exceeding millions of instructions per second. Indeed, there is a current need for intelligence to be transmitted via cables externally of computers to peripheral apparatus such as printers at speeds exceeding 10 to 12 kilohertz. With this progress, technology has moved from a time when a couple of wires hung on insulators carried on wooden poles were more than adequate, to a time when twisted pair cable is no longer sufficient for many requirements and the energy of intelligence itself is no longer carried essentially in the conductive material of the wire. This is because at the high speeds of transmission, the energy is propagated essentially in the dielectric medium proximate to the conductor of the wire and is of a nature easily interfered with by the electrical and the electromagnetic fields extant. With this change, concepts of impedance matching and the effects of physical dimensions of connector and cable have become critical.

As this has occurred, the need to design to accommodate higher signal speeds or the equivalent shorter signal wavelengths has become evident. Not obviously, but clearly, that need has manifested itself in design parameters calling for physically, dimensionally, smaller parts and portions of connectors and cable. This has been caused by the discovery that when such parts are physically very short compared to the wavelength or the equivalent pulse shape of the signals of transmission, there can be less signal reflection and a more efficient transmission through the cable and through associated connectors.

Hand-in-hand with the foregoing has been a reduction in size in both cable and connectors to a point wherein the ability to physically handle the constituent parts of both has proven difficult. When the wires of the cable are only several times in diameter of that of the human hair and the parts of the connector are necessarily smaller than a grain of rice and even the best of vision can no longer discern left from right in these elements, one can readily perceive the problems caused. Quite unfortunately, the problems which are manifest in the ability of human beings to do what is necessary to put connectors together and assemble connectors to cable are not necessarily solved merely by turning to machines to put things together. This is particularly so when the things that must be put together cannot be produced or reproduced by processes intrinsically capable of down scaling such as by photolithography, silk screening, or the like. Indeed when things must be made in three dimensions rather than two, miniaturization in manufacture and handling becomes quite difficult and operates as a barrier to progress.

With the foregoing as context, it is an object of the present invention to provide a method and apparatus for handling and terminating the small parts of signal transmission cable and related connectors in a manner which is practical in terms of manual assembly and automation.

It is a more specific object of the present invention to provide a method and apparatus which makes it easier to handle the parts and portions of connectors and cable which are of small physical dimension necessitated by the requirements of the signals transmitted thereby.

It is yet another object to provide a coaxial connector and technique for application thereof to cable which is both amenable to physical handling by human beings and as well by machines.

Finally, it is an object of the invention to provide an interconnection system of improved performance in the face of rigorous demands upon dimensional integrity.

SUMMARY OF THE INVENTION

A connector assembly according to an aspect of the invention is constructed of two separate parts, an insulative wire management fixture for assembly to slender wires of an electrical cable, and an electrical terminal portion of an electrical connector that is capable of assembly with the fixture and that establishes electrical connections with the slender wires.

The wire management fixture has an elongated shape with a tapered nose and an enlarged diameter collar at an end opposite to the nose. Passageways extend in a direction longitudinally within and through the interior of the fixture, and are spaced apart the same distance as are slender wires within an electrical cable for transmitting high speed electrical signals. The fixture is oriented with the slender wires, and then the slender wires are threaded into and along and through the passages. Introducing the slender wires into the passages is facilitated by funnel entries of the passages.

Orientation of the fixture with the slender wires is facilitated by ears of the fixture, which ears project laterally from the fixture and in directions opposite to each other. The projecting ears provide a cross section of the fixture that is generally rectangular, for example, narrow in width and broad in principal breadth. The narrow width and broad principal breadth provides a contrast of dimensions that invites grasping of the fixture manually between thumb and forefinger across the narrow width rather than across the broad principal breadth. The width and breadth provides a contrast of dimensions that facilitates tactile feel and tactile orientation of the fixture, despite its small size.

The principal breadth of the fixture extends along the same axis as does the lateral spacing between the passageways. Tactile orientation of the principal breadth and of the passageways is manifest from the tactile feel associated with a manual grasp of the fixture across the narrow width. Tactile orientation of the passageways facilitates orientation and alignment of the passageways with the slender wires of the cable.

Assembly of the fixture on the slender wires causes the wires to project outwardly from the tapered nose of the fixture. The wires are manually doubled back on themselves to lie along the exterior of the fixture, and more particularly, along grooves recessed along the tapered nose and along the narrow width of the fixture. The width and breadth of the fixture provides a contrast of dimensions that assures a tactile distinction of the narrow width from the broad principal breadth of the fixture. Such a distinction facilitates tactile, manual manipulation and tactile, manual orientation of the wires as the wires are manually manipulated to arrive at their respective positions along the exterior of the fixture. The tactile distinction of the narrow width from the major breadth of the fixture avoids mistaken orientation of the wires along the principal breadth.

The contrast of dimensions provided by the tapered configuration of the tapered nose facilitates accurate manual manipulation of the wires as they are doubled back along the exterior of the tapered nose and further along the narrow width of the fixture.

Another aspect of the invention resides in electrical terminals of the connector assembly that are spaced apart a distance to span the narrow width of the fixture, such that the width of the fixture guides the terminals into overlapped and wedged engagement with corresponding slender wires positioned along the width of the fixture. The terminals are spaced apart a distance to span the narrow width of the fixture, and not the principal breadth of the fixture. The contrast of dimensions of the width and breadth of the fixture assures tactile distinction of the narrow width of the fixture from the broad principal breadth, and facilitates accurate manual manipulation of the terminals to span the narrow width of the fixture and to align and engage the slender wires.

Another aspect of the invention is that the terminals are provided with wire receiving slots open at the free ends of the terminals and having slots that taper in corresponding widths toward the open ends. The open ends are less wide than the corresponding diameters of the slender wires to be received in the slots. As the terminals are moved toward the wires, the wires impinge the restricted width of the slots. The terminals have resilient spring properties that tend to close the slots onto the wires, and require the wires to wedge in the slots, and thereby establish electrical connections with the terminals.

Accordingly, an object of the invention is to provide an electrical connector assembly of a configuration suitable for combination with an electrical cable for transmission of high speed electrical signals along the connector assembly with negligible backward cross talk and minimum reflection of signals.

Another object of the invention is to provide an electrical connector assembly constructed for tactile manipulation of slender wires of an electrical cable for high speed electrical signals, and for tactile and accurate manipulation of small metal parts to form electrical connections between the wires and the small metal parts in the connector assembly.

Another object of the invention is to provide a wire management fixture having a contrast of external dimensions that invites manual grasping, and that facilitates tactile, manual manipulation of slender wires into and along passageways of the fixture, and that facilitates orientation of the wires along desired external surfaces of the fixture.

Another object of the invention is to provide an electrical connector assembly of small size and constructed of two parts, an insulative wire management fixture for tactile orientation and assembly with slender wires of an electrical cable for transmitting high speed electrical signals, and an electrical terminal portion of an electrical connector for tactile orientation and assembly to the fixture and electrical connection with the slender wires.

Another object of the invention is to provide a method for electrically connecting slender wires of an electrical cable to conductive electrical terminals using a tactile orientation and assembly of the wires, first to a wire management fixture capable of tactile manual manipulation despite its small size, and then to a set of electrical terminals capable of tactile manual orientation and assembly to the fixture and electrical connection to the slender wires.

Another object of the invention is to provide a wire management fixture and an electrical terminal portion of an electrical connector that are of small size and are constructed for tactile orientation and for assembly to each other by tactile manual manipulation.

The foregoing objects are accomplished in accordance with the present invention by method and apparatus in which the several conductors of a transmission cable are inserted into a wire management insulating fixture having a configuration which can be oriented to the wires in either one of two tactilely identifiable orientations, and once oriented places the conductors in a proper position for further insertion into a connector operating to terminate such cable in a desirable manner. The wire management fixture is dimensioned to make such insertion straight forward and the connector is correspondingly dimensioned and characterized in its construction to facilitate such insertion. Basically, the wire management fixture after orientation with the cable places the conductors of the cable in a position which fits one and only one tactilely sensitive orientation relative to the connector. Preparation of the cable and disposition of the cable conductors or wires, coupled with the dimensioning and geometry of the wire management fixture, tend to make it easy to effect a proper insertion and difficult to make mistakes.

The connector is rendered in a consistent rear shape relative to the wire manager and method of joining cable to connector with a wide variety of options for the front end of the connector. The invention contemplates configurations of a coaxial nature, of a solder tab nature, of a post or socket nature, and of an adapter configuration capable of mating into a wide variety of standard high frequency connector geometries.

By the shape of the wire manager and connector terminating portions, the present invention in terms method or apparatus makes it not only easy for an individual to put the connector and cable together, but makes it possible to design machinery practically and easily toleranced to reproduce such function.

The foregoing objects are accomplished in accordance with the present invention by method and apparatus in which a plastic and insulating wire manager allows one or more wires of a high speed signal transmission cable to be inserted therein and positioned for insertion into a connector having one or more terminating portions slotted to receive the wire and made flexible to allow accommodation for axial insertion and deflection. Following axial insertion, the slotted portions are displaced radially to capture and position the wire of the cable very precisely for subsequent permanent termination by a radial displacement of the slotted portion into a precise gripping of the wire by the elements of the slotted portion. In conjunction with this feature, the wire may be welded, fused, or otherwise joined to the electrically conducting parts of the connector in a precise manner afforded by the geometries and relationships between terminal portions and the wire.

In accordance with the invention, the rear portions or slotted portions which terminate the wires of a transmission cable can be rendered in a variety of forms forward of the termination to include structure for a coaxial connector, solder tabs, pins or sockets and/or an adaptor structure.

BRIEF DESCRIPTION OF THE DRAWINGS

The features and advantages of the invention will be further appreciated in relation to the detailed description which follows as applied to the accompanying drawings.

DETAILED DESCRIPTION OF THE INVENTION

Figure 1:
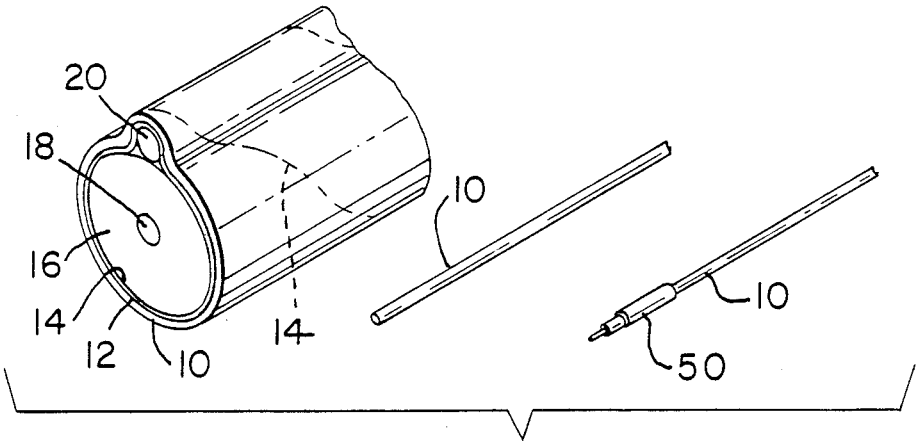
FIG. 1 is a perspective showing to the left a high speed signal transmission cable much enlarged relative to, on the immediate right, a cable roughly of actual dimension, and further a similar cable terminated by a coaxial connector of more or less actual dimension.

Referring now more particularly to the drawings, the preferred embodiment of the method and apparatus of the present invention will now be described. The method of the invention relates to the termination of cable of the kind shown in FIG. 1, through a series of steps shown more particularly in FIGS. 2 through 14 which add sequentially, elements of the apparatus of the invention to effect such termination. Referring now to FIG. 1, three views of a coaxial cable 10 are shown with the left-hand view being much enlarged over the right-hand views which are approximately drawn to scale. The right-hand cable 10 has a coaxial connector 50 terminated to the end thereof, also being shown roughly to scale.

The cable 10 in FIG. 1 includes an outer plastic sheath 12 which is typically on the order of 0.002 inches in thickness, beneath which is a shielding typically of aluminum foil 14 of a similar dimension wrapped around the cable insulation 16, either longitudinally or spirally. This cable insulation is comprised of a dielectric material, which is typically foamed or otherwise made porous and of Teflon or, alternatively, a highly expanded irradiated polyolefin. The dielectric 16 is in accordance with the invention, made to have characteristics of velocity of propagation and dielectric constant as close to air as is possible and still provide structural support to the conductor portions of the cable. Centered within insulation 16 is a signal conductor or wire 18, typically solid and of plated copper. In FIG. 1, a drain wire or grounding conductor 20 is shown at the periphery of the cable and extending along an edge thereof within and in close proximity to the foil 14. As can be discerned from FIGS. 2 and 3, the drain wire 20 is preferably held parallel to the signal conductor 18 along its length to assist in termination. Element 20 serves to contact the foil 14 along the length of the cable and maintain the foil in electrical connection therewith. In certain constructions of cable like that shown in FIGS. 1 through 3, the grounding or shield wire 20 is alternatively placed on the outside of the foil 14 sandwiched between 14 and 12 in order to serve the same function.

Cables like 10 come in a variety of dimensional sizes typically designed to have characteristic impedances such as 50, 75, or 90 ohms to make them compatible with the particular electronic package and system with which they are to be used. The conductors 18 and 20 are typically 30 AWG or 0.010 inches for 50 ohm cable and 32 AWG or 0.008 inches for 75 and 90 ohm cable. The diameter of dielectric 16 would be on the order of 0.027 inches for 50 ohm cable, 0.030 inches for 75 ohm cable, and 0.039 inches for 90 ohm cable. As can be appreciated, the signal and drain wire conductors 18, 20 are on the order of several diameters larger than a human hair and the overall cable is much smaller in diameter than the lead in a common wooden pencil.

As has been heretofore mentioned, the physical dimensions of cables and connectors utilized to accommodate a high speed signal transmission are quite critical. The difficulty that this imposes upon assembly of connectors such as 40 onto cable 10 can be best understood by realizing that the cable must be stripped and the signal and drain wire conductors 18, 20 exposed and handled and manipulated relative to the portions of the connector 40 in a manner which will not allow movement or subsequent physical displacement which might cause signal reflection, cross talk, and general loss of efficiency of signal transmission. The delicate nature of cables such as 10 and associated connectors has indeed made the assembly and method in times past one of great difficulty and expense, when performed in the laboratory or in a clean room of a factory under magnification. Alternatively, termination techniques and connector designs were employed wherein a reduced performance at the termination point was deemed necessary or acceptable.

Figure 2:
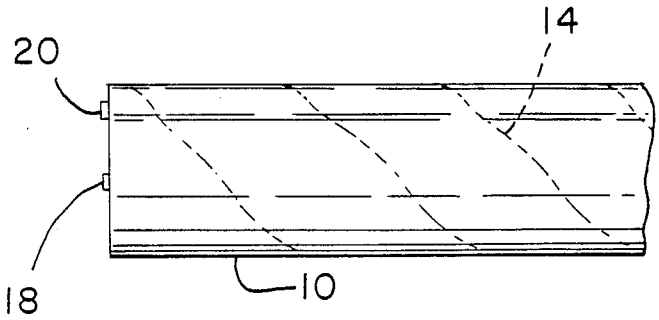
FIG. 2, a side view of the enlarged representation of FIG. 1.
Figure 3:
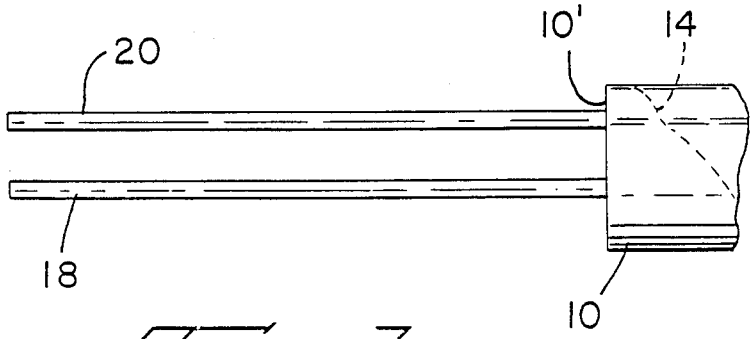
FIG. 3 represents the cable of FIG. 2 having portions thereof stripped away to show the signal and ground conductors preparatory to termination.
Figure 4:
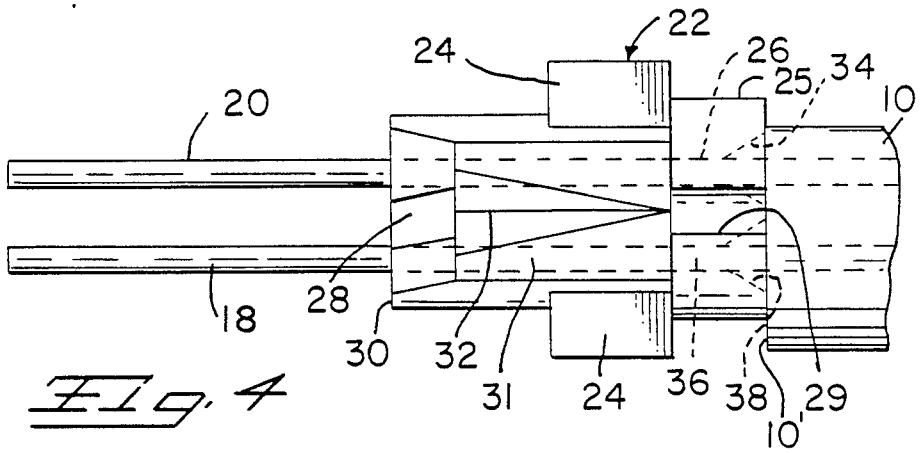
FIG. 4 shows the cable as prepared in FIG. 3, but with the insertion of a wire management fixture thereupon.
Figure 6:
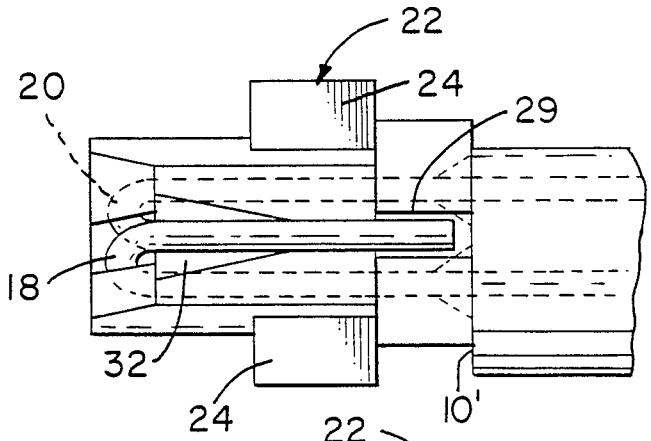
FIG. 6 is a view of the ensemble of FIGS. 4 and 5, but with the conductors or wires of the cable bent or folded back or displaced in accordance with the method of the invention and intended to reveal the advantages of certain structural features of the wire management fixture.

Turning now to a further description of the invention, the cable 10 can be seen in FIGS. 2 and 3 to have been cut back of its outer protective sheath 12, of foil skin 14 and dielectric medium 16 to a cut end 10′ thus to expose 18 and 20 along a length thereof. The appropriate dimension for this length can be discerned from the subsequent steps of the method of the invention, as depicted in FIGS. 4 and 6, where it can be seen that a wire manager 22 has been inserted over 18 and 20 and drawn therealong to fit against the cut end 10′ of cable 10. The wire manager 22 is typically a one-piece molding of plastic of the type capable of withstanding the higher temperatures associated with soldering, welding and brazing to be hereinafter described.

Figure 5:
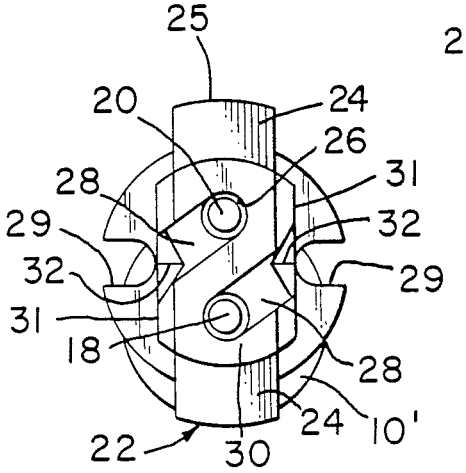
FIG. 5 is an end view as taken from the left of the ensemble of FIG. 4.
Figure 7:
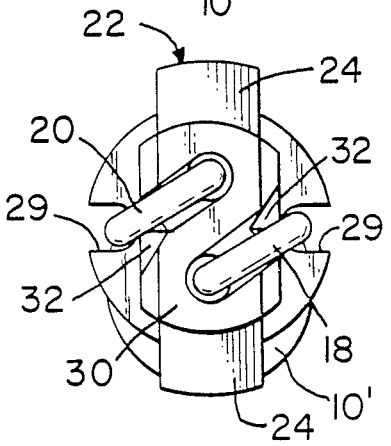
FIG. 7 shows an end view from the left of the structure of FIG. 6, FIG. 7A showing a perspective of the elements of FIG. 7.

Wire manager 22 may be typically made of polyphenylene sulfide, commercially known as Ryton R4, and may be seen to include, as shown in FIGS. 4, 5, and 7, a pair of projecting ears 24 which assist in orientation of the wire manager during manual or machine handling. To the right side of the element 22 as shown in FIGS. 4 and 5 is an external, radially projecting collar portion 25 having a groove 29 therein on each side adapted to receive the ends of 18 and 20 when folded or doubled back to register upon the exterior of the wire manager 22 as shown in FIG. 6. Projecting forwardly of the ear portions 24 is a projecting nose portion 30 which includes on each side exterior 31 a relieved portion or V-form groove 32, as best shown in FIGS. 4 and 6, which tends to help center and align the wires 18 and 20, respectively, toward and into the corresponding groove 29 during the doubling back or folding procedure. The end and internal configuration of 30 can best be seen in FIGS. 5 and 7. Internal to 22 are a pair of passageways 26 and 36 which extend lengthwise through 22 to accommodate the wire conductors 18 and 20. These passageways are flared at their ends to form funnels shown as 34 and 38 to help guide 18 and 20 into the passageways and thus aid in ease of assembly.

Figure 7A:
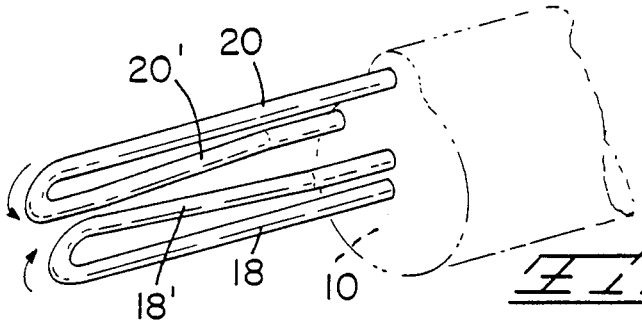

With wire manager 22 positioned and seated on the cut and stripped end 10' of cable 10, the conductors 18 and 20 are then bent or folded back around the wire manager to the positions shown in FIGS. 6 and 7. In this position, the wires of the conductor ends are doubled back and bent around the front end edges of 30, and along the tapered nose of 30 in V-form grooves 32 to form slanting or sloped beam portions 18', 20' as shown in FIG. 7A. The ears are 0.030 inches in width and provide a principal breadth of 0.095 inches. The diameter of the collar 25 is 0.070 inches. The width of the body extending between the ears and extending from the collar 25 to the taper of the wire is 0.040 inches.

The method of the invention as thus far revealed indicates that the cable 10 is first stripped to an appropriate length with the wire manager 22 being inserted over the conductors 18 and 20 which conductors are then folded back around and worked into grooves contained on the wire manager. While the conductors and the wire manager on the cable itself are indeed quite small, the structural features heretofore detailed allow one to manually accomplish these steps quite readily, essentially because of the prominant projections 24, 25 and 30 and because of geometry which assure proper insertion of the wires 18, 20 into the passageways 26, 36 and along the grooves 32 and 29, without a requirement for inordinate tactile dexterity.

Figure 8:
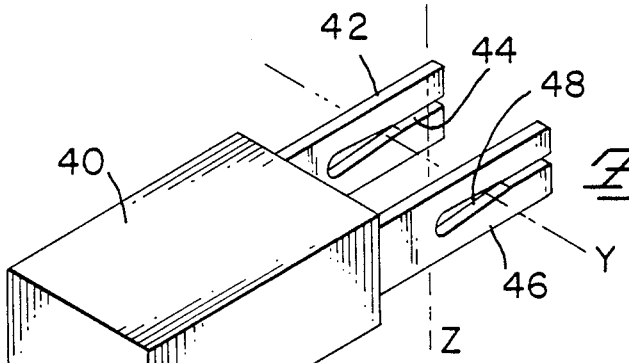
FIG. 8 shows in perspective a block having terminal portions and structure to the right, the block representing a wide variety of terminating structures to be hereinafter detailed.
Figure 9:
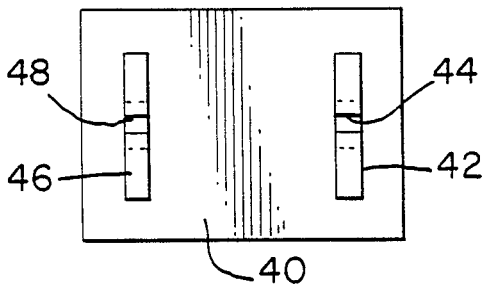
FIG. 9 shows an elevational view as taken from the right end of the structure of FIG. 8.

Turning now to FIGS. 8 and 9, the next aspect of the invention is shown with respect to a connector 40 or disconnect termination device 40 which will be understood at this point to represent a variety of different kinds of connectors or terminals, dependant upon the application of use required. Connector 40 has, in any event, two blade-like terminals 42 and 46 extending from the rear thereof, each terminal including an appropriate slot which is shown as 44 relative to 42 and as 48 relative to 46. In accordance with the invention, the terminal portions 42 and 46 are quite thin, in an actual embodiment being on the order of 0.006 inches. In order to make these portions resilient spring flexible, they are held in width to a suitable dimension which in an actual embodiment, was on the order of 0.040 inches, with a length of roughly 0.100 inches. The slots which are shown as 44 and 48 were in an actual embodiment made roughly 0.080 inches in length having at the open end a dimension of 0.008 inches and at the closed end a rather wider dimension such as 0.010 inches. In an actual embodiment, the terminal portions 42 and 44 were formed of a copper nickel alloy temper number 2 suitably plated with an appropriate finish of noncorrosive metal. As part of the invention, the terminal structures 42 and 46 need to be elastic or resilient spring flexible to be able to spread apart in two senses. In the first sense, they need to be able to spread apart one from the other along what is shown to be a Y axis in FIG. 8. In another sense, they need to individually be capable of spreading to widen the widths of the slots along Z axis, also as shown in FIG. 8. The need for this will become more apparent from viewing FIGS. 10–14.

Figure 10:
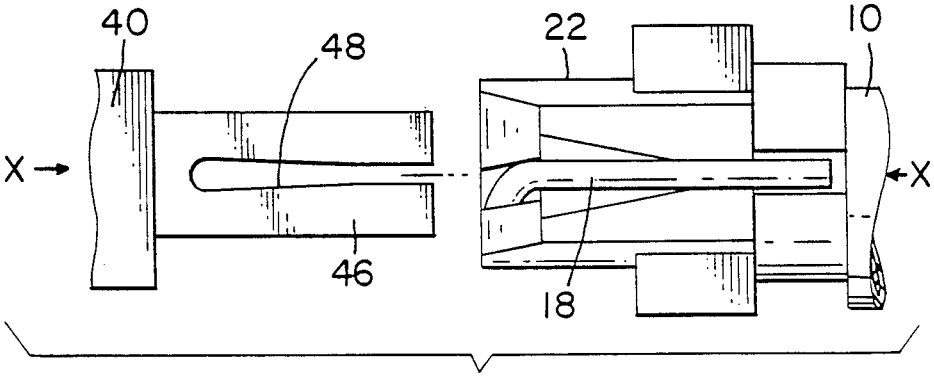
FIG. 10 shows a side view of the structure of FIG. 8 in conjunction with the side view of the cable and defining the wire management fixture as depicted in FIG. 6 preparatory for insertion.
Figures 10A, 11:
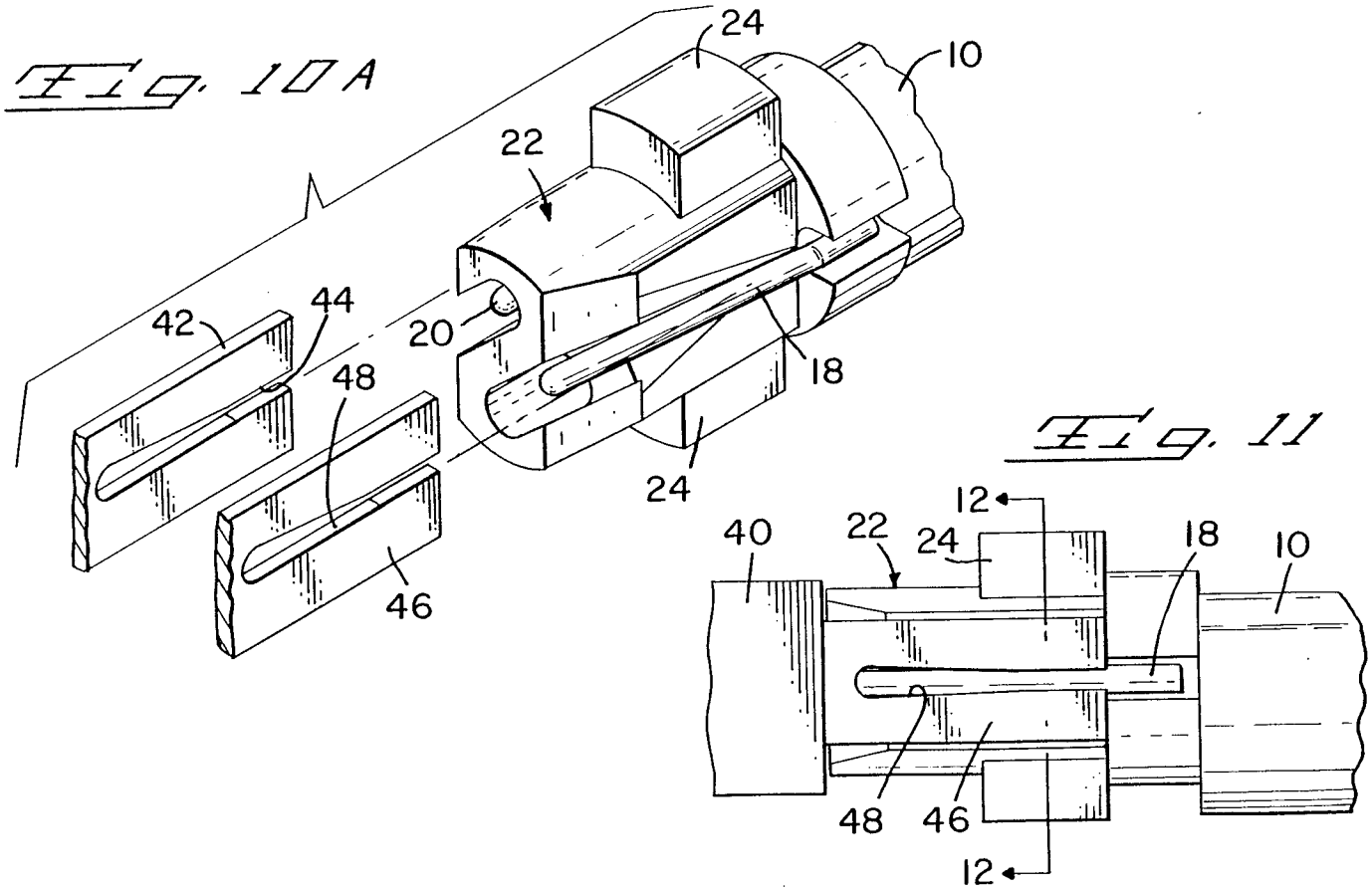
FIG. 10A is a perspective view of the structure shown in FIG. 10.
Fig. 11 shows the structure of FIG. 10 as inserted, with FIG. 11A showing the structure of FIG. 11 in perspective.
Figure 11A:
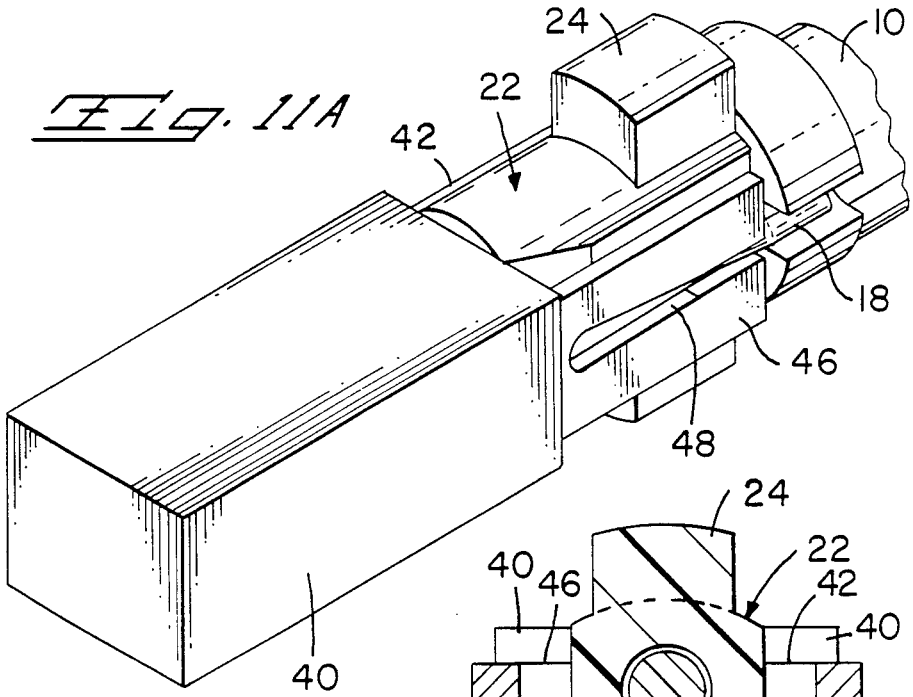
Figure 12:
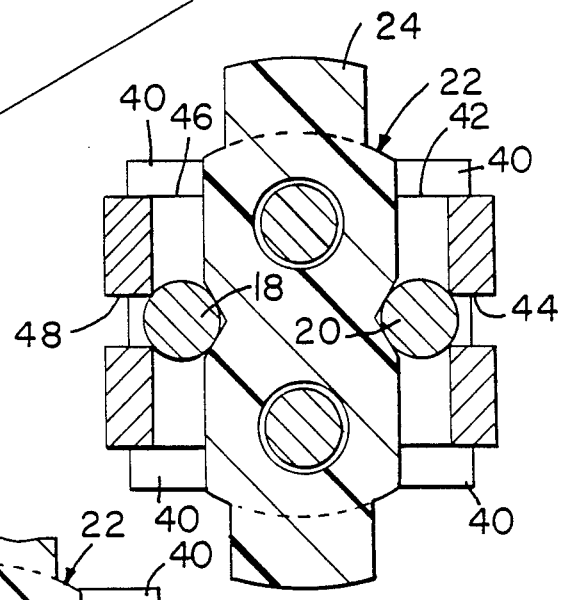
FIG. 12 shows a section of the structure of FIG. 11 embracing initial cable wire insertion into the connector.

In FIG. 10, the connector 40 is shown positioned relative to a cable 10 and a wire manager 22 having been prepared and assembled in the manner indicated in FIGS. 6–7A. FIGS. 11 and 12 show these two parts assembled, the slot structures 44, 48 of the terminals 42 and 46 operating to center the cable 10 by receiving the corresponding conductors 18, 20 in detent action along the slots 44, 48, while the edges of the slots slide along the exterior surfaces of the conductors 18, 20. During this operation, the ears 24 quite readily admit to being positioned between a thumb and forefinger during manual insertion or between thumb and forefinger equivalents in the form of mechanical grippers of a machine (not shown).

The flexibility of terminal elements 42 and 46 accommodate to any slight dimensional disparity, deflecting appropriately to help ease insertion.

Another aspect of the invention resides in electrical terminals of the connector assembly that are spaced apart a distance to span the narrow width of the fixture, such that the width of the fixture guides the terminals into overlapped and wedged engagement with corresponding slender wires positioned along the width of the fixture. The terminals are spaced apart a distance to span the narrow width of the fixture, and not the principal breadth of the fixture. The contrast of dimensions of the width and breadth of the fixture assures tactile distinction of the narrow width of the fixture from the broad principal breadth, and facilitates accurate manual maniuplation of the terminals to span the narrow width of the fixture and to align and engage the slender wires.

Another aspect of the invention is that the terminals are provided with wire receiving slots open at the free ends of the terminals and having slots that taper in corresponding widths toward the open ends. The open ends are less wide that the corresponding diameters of the slender wires to be received in the slots. As the terminals are moved toward the wires, the wires impinge the restricted width of the slots. The terminals have resilient spring properties that tend to close the slots onto the wires, and require the wires to wedge in the slots, and thereby establish electrical connections with the terminals.

Figure 13:
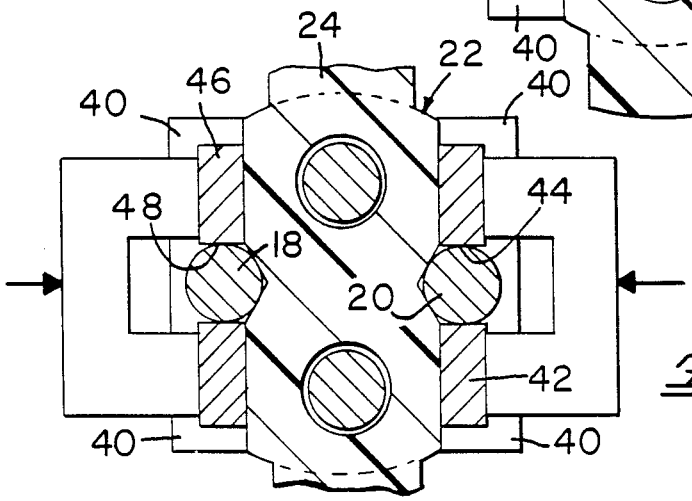
FIG. 13 shows a section of the structure of FIGS. 11 and 12 following insertion and axial displacement of the wire of the cable into the terminals of the connector, FIG. 13A showing a perspective of this detail.
Figure 13A:
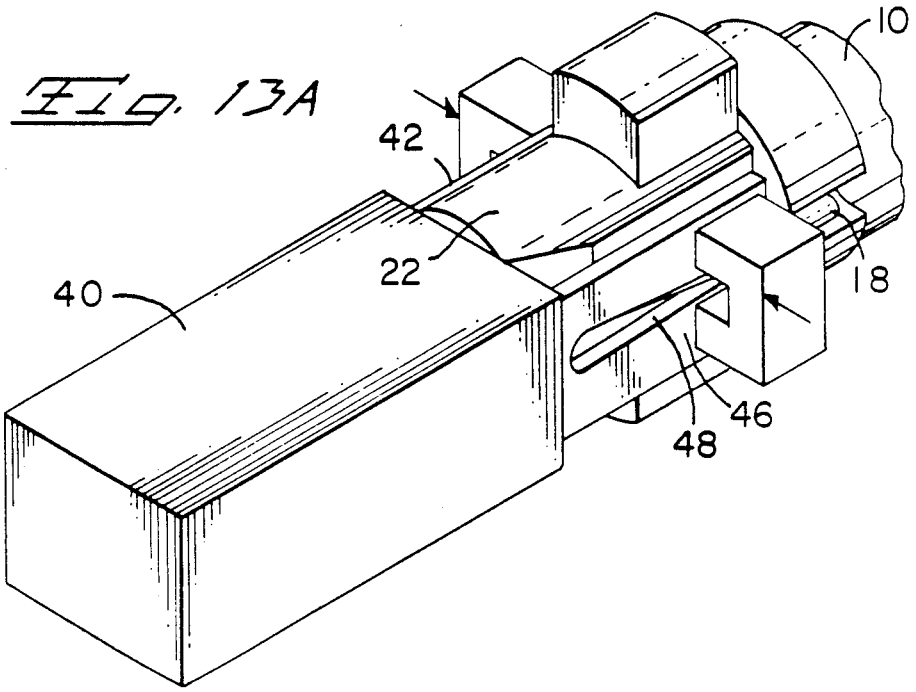

In FIG. 13, the terminal elements 42 and 46 are forced radially inwardly so that portions of the conductor wires 18 and 20 are forced within the slots 44 and 48 as better shown in FIG. 13*a*. The need for deformation of the terminals 42 and 46 can thus be appreciated. The wires are wedged in the slot 44 and 48 which are forced to widen and receive the wires by the alternative steps of either forcing the wires to enter the open ends of the slots as the terminals 42 and 46 are assembled to the wire management fixture, or, alternatively forcing the terminals 42 and 46 radially inward as shown in FIG. 13.

Figure 14:
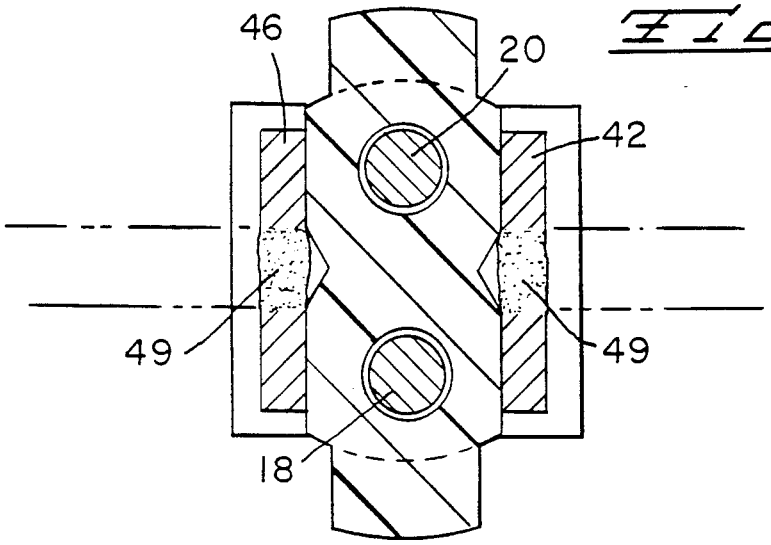
FIG. 14 represents a section view of the structure of FIG. 13 following welding as an illustrative example of termination of the cable wires to the terminals.
Figures 14A, 15:
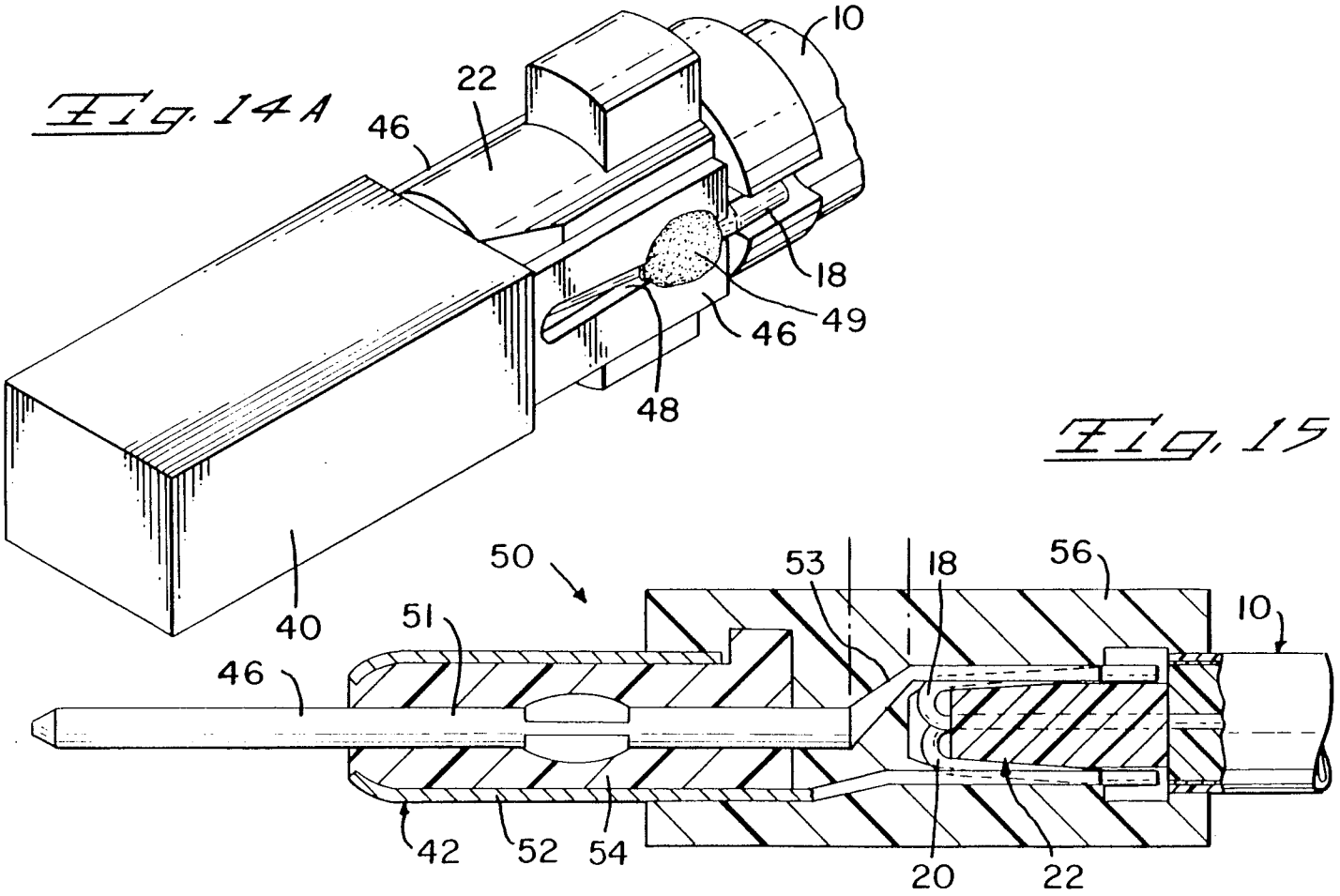
FIG. 14A is a view similar to FIG. 13A, showing a solder connection of the wire and terminal of FIG. 13A.
FIG. 15 reveals in section an exemplary embodiment of a coaxial connector having the structure of the invention as applied by the method of the invention to a coaxial high speed transmission cable.

In FIG. 14, a subsequent step at least in one version of the invention as shown, wherein the conductors 18 and 20 are caused to be permanently joined to structures 42 and 46, respectively by being welded thereto, the depiction in FIG. 14 representing the use of laser beam welding in spots 49 as shown in FIG. 14*a*. It is understood that other forms of welding and/or fusion or solder reflow may appropriately be employed.

Important to the invention, of course, is the assembly of the cable conductors into the wire manager with the subsequent positioning of the wire conductors and the connector so as to ensure that surfaces of the conductors are appropriately placed relative to the outer surface portions of 42 and 46. This placement allows the welding or fusion heretofore discussed proximate to the surface of the terminal elements meant to reduce the overall heat load impressed upon the connector which might otherwise be the case.

In brief summary at this point of the description, the cable such as 10 has been terminated by the use of a wire management fixture 22 following appropriate stripping with the signal and drain wire conductor folded thereupon into a rather precise relationship, and with the ensemble being inserted in the rear end of a connector structure 40 having terminal elements positioned and dimensioned and made sufficiently flexible to aid in insertion. Thereafter, the terminal elements have been displaced inwardly in a radial sense to capture the signal and drain wire conductors 18 and 20 and position portions thereof for subsequent joining as by laser, welding or fusion or other means of termination. It is to be understood that it is contemplated that the connector structure 40 may embrace a wide variety of appropriate designs to the industry. FIG. 15 shows in section one such design in the form of a coaxial connector 50. Relative to 50, there is an outer or grounding and shielding shell 52, the end portion of which is made to form one of the terminal elements heretofore discussed shown as 42, suitably terminated to the drain or ground conductor 20 as heretofore discussed. The shell element 52 may be formed of an appropriate metal such as a copper nickel alloy suitably plated with an appropriate gold and silver plating of an appropriate thickness. Contained within 52 and locked thereto is a plastic fixture 54 which has appropriate dielectric characteristics as well as structural characteristics to form the function intended. In an actual unit, element 54 was formed of a molded polyethelene similar to Alathon 1540, a commercially known engineering plastic.

Captured within the structure 52, 54 is a signal carrying pin 51 typically round and suitably plated with an appropriate gold over nickel electrodeposit. In an actual example, the pin 51 was on the order of a diameter of 0.0180 inches with the end portion forming terminal 46 being reduced to a 0.006 inch thickness by spanking in the die of manufacture. In this regard, care must be taken to provide an appropriate transition region shown as 53 which will allow appropriate flexure of 46 without breaking the element away from the main pin portion. With respect to FIG. 15, a further sleeve portion shown as 56 has been formed over the junction of the connector and the cable including the wire manager fixture and the termination thereabout. In one particular embodiment, this element 56 was formed by post molding controlled durometer PVC plastic under pressure to make certain that the interconnection was adequately sealed and that all elements therewithin were restrained from movement or displacement, the molding taking place under considerable pressure to force the plastic in a liquid state into all the interstices and crannies of the ensemble. With respect to the coaxial cable assembly of FIG. 16, high frequency signal energy being propagated down 10 is carried through the connector in the dielectric mediums thereof, including 22 and 54, and in the center pin contact with the drain and ground being extended from the conductor 20 to the shield content structure element 52.

Figure 16:
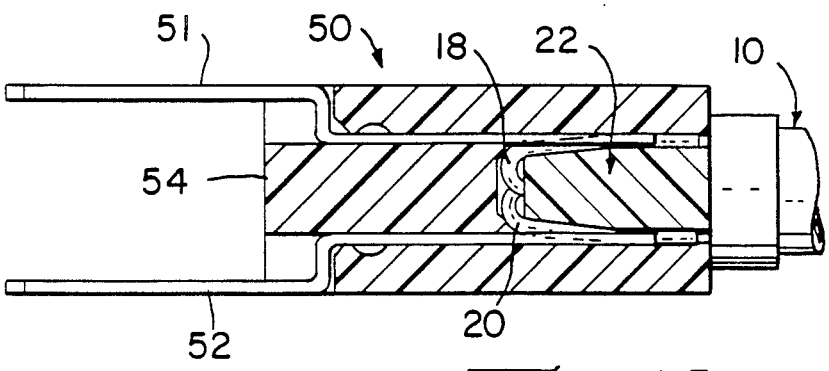
FIG. 16 shows the apparatus of the invention in an embodiment wherein the connector portion is in the form of solder tabs suitable for termination to a printed circuit board or other structure defining signal and ground paths; with FIG. 16A showing the embodiment in perspective.
Figure 16A:
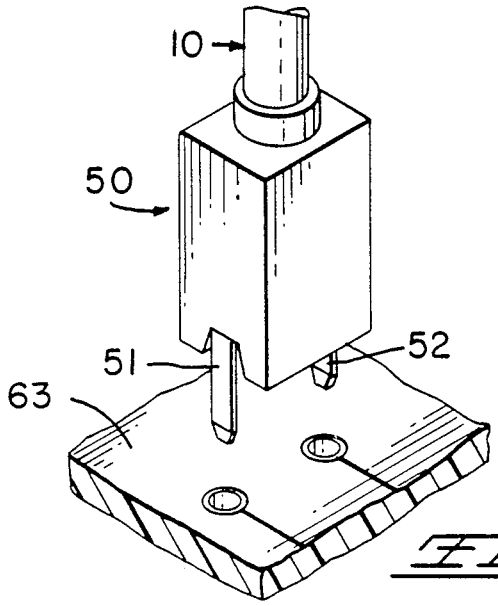

Turning now to FIGS. 16 and 16A, there is shown a variation of the connector 50 wherein the front end, rather than being a coaxial structure as described relative to FIG. 15, is made up of solder tabs 51 and 52 which operate to terminate the transmission cable 10 to a printed circuit board 63 or the like, by insertion as indicated in FIG. 16*a* into holes in such structure and subsequent soldering of the paths of signal or ground to the appropriate paths in the board structure.

Figure 17:
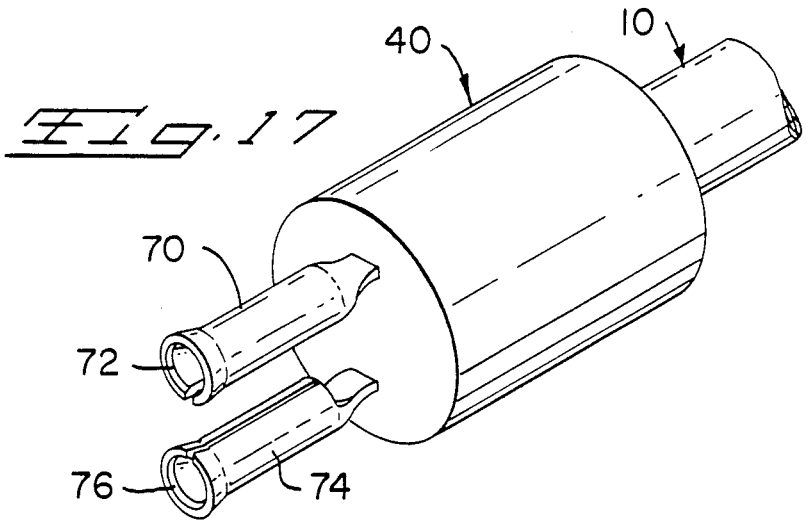
FIG. 17 shows the apparatus of the invention as applied to sockets for signal and ground termination in a pluggable form.

FIG. 17 shows yet a further version of the connector 40, wherein in addition to the termination heretofore described, includes terminal portions 70 and 74 which terminate to the shield and signal portions of cable 10. Elements 70 and 74 have appropriate socket structures inwardly formed on the ends thereof, shown respectively as 72 and 76, adapted to be fitted over contact pins or posts either in a connector joining another cable such as 10 or appropriately mounted in a printed circuit or flexible circuit portion of an electronic package. The connector 40 of FIG. 17 is thus intended to be mated and unmated and would, of course, have an appropriate plating at least within the interior of the socket portion 72 and 76.

Figure 18:
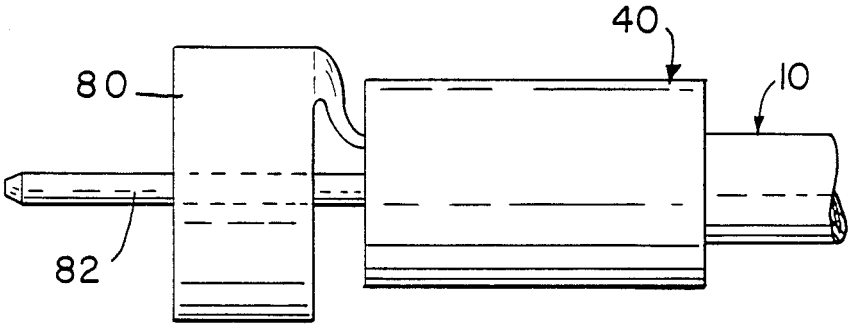
FIG. 18 reveals an embodiment of the invention embracing the concept of an adapter wherein the invention method and apparatus joins an adapter suitable to interconnect with a wide variety of larger coaxial and other types of terminations, with FIG. 18A showing this embodiment in perspective.
Figure 18A:
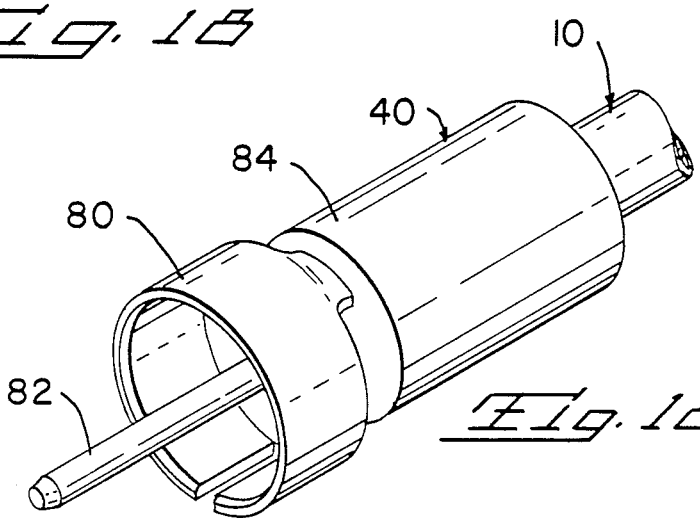

FIG. 18 shows a representation of the connector 40, wherein in addition to the terminal heretofore described relative to cable 10, portions 80 and 82 connected to the shielding and signal portions of 10 are extended and given end geometries which may vary in accordance with or adapted to existing connectors. One such application for a BNC connector is shown in FIG. 18A in perspective, wherein the signal conductor terminal 46 is the rear end of a pin 82 and the terminal 42 is the rear end of a cylindrical portion 80 that is inserted over the shielding portion 14 and crimped downwardly joining the shielding 14 of cable 10 to a shielding ring 80 of the connector. In FIG. 18A, a dielectric element 84 is employed to hold a position and stabilize the elements 80 and 82 relative to each other. In a sense the connector 40 is given portions which simulate the particular cables of use such as RG specification cables and for BNC type coaxial connectors.

In the foregoing description and disclosure, the various terminations and connectors have been depicted as singular relative to a single cable 10. It is to be understood that the invention contemplates multi-terminations wherein the various and sundry connector structures are carried in multiples such as two through twelve or more, made modular formultiple mounting, and so forth.

In the drawing specification, there have been set forth preferred embodiments of the invention, and all those specific terms employed, are used in a generic and descriptive sense only and not for purposes of limitation which is intended to be made manifest in the claims.

We claim:

1. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, said passages emerging at an end of said first body, and said groove means having depths that decrease as said groove means extend from said end of said first body.

2. An electrical connector for connection with multiple slender wires of an electrical cable, comprising;

a first insulative body dimensioned for connection with said slender wires, said first body being a substantially solid unitary body and including:

an elongated longitudinal axis and first and second axes transverse thereto, said first insulative body being wider along said first axis than said second axis, tactile orientation means comprising projections extending from said first body in the direction of said first axis, wire receiving passages extending longitudinally through said first body, each of said passages being dimensioned to closely receive a separate uninsulated slender wire, said passages being spaced apart laterally from one another along said larger width portion, and flat sidewalls on opposite sides of said smaller width portion having wire receiving groove means for receiving slender wires emerging from said passages, said connector further comprising a second insulative body including conductive electrical terminals for connection along said flat sidewalls with said slender wires, said terminals having wire receiving slots, said slots having widths less than corresponding said wires, and open ends of said slots facing said first body for receiving corresponding said wires.

3. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, collar means axially spaced from said sides of the first body and projecting laterally outward with respect to said sides of the first body, and wire receiving grooves in said collar means aligned with corresponding said groove means.

4. In an electrical connector for connecting with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, insulative means for covering said opposite sides of the first body, for covering corresponding said wires received by said opposite sides and for engaging said terminals received by said opposite sides, and said insulative means being a part of said second body.

5. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of a larger width portion, the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, insulative means for covering said opposite sides of the first body, for covering corresponding said wires received by said opposite sides and for engaging said terminals received by said opposite sides, and said insulative means surrounding said second body and said first body.

6. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the fist body extending transversely of the larger width portion, the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, and one of said terminals having a portion forming a conductive pin, and another of said terminals having a portion forming a ring surrounding said pin.

7. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, collar means axially spaced from said sides of the first body and projecting laterally outward with respect to said sides of the first body, wire receiving grooves in said collar means aligned with coresponding said groove means, and insulative means surrounding said first body and engaging said collar means for covering said opposite sides of said first body, for covering corresponding said wires received by said opposite sides and for engaging said terminals received by said opposite sides.

8. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, and the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, wherein said passages emerge at an end of said first body, and said groove means have depths that decrease as said groove means extend from said end of said first body.

9. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, and the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, further comprising collar means axially spaced from said sides of the first body and projecting laterally outward with respect to said sides of the first body, and wire receiving grooves in said collar means aligned with corresponding said groove means.

10. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, and the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, further comprising insulative means for covering said opposites sides of the first body, for covering corresponding said wires received by said opposite sides and for engaging said terminals received by said opposite sides, said insulative means surrounding said second body and said first body.

11. In an electrical connector for connection with multiple wires of an electrical cable, comprising; wire receiving passages extending through an insulative first body, said first body having sides for receiving corresponding said wires emerging from corresponding said passages, conductive electrical terminals supported by an insulative second body and received by said sides for connection with corresponding said wires received by said sides, the improvement comprising;

the first body having tactile orientation means for providing a larger width portion of the first body and a smaller width portion of the first body extending transversely of the larger width portion, and the first body being adapted with a slender size for connection with wires of a cable having a corresponding slender size, by said passages being spaced apart laterally from one another along the larger width portion, and by wire receiving groove means extending along opposite sides of the smaller width portion for receiving corresponding said wires, said opposite sides being said sides of said first body, wherein one of said terminals has a portion forming a conductive pin, and another of said terminals has a portion forming a ring surrounding said pin.

12. In an electrical connector as recited in claim 9, the improvement further comprising insulative means surrounding said first body and engaging said collar means for covering said opposite sides of said first body, for covering corresponding said wires received by said opposite sides and for engaging said terminals received by said opposite sides.

13. In an electrical connector as recited in claim 12, the improvement further comprising said insulative means being a part of said second body.

* * * * *